US006106377A

United States Patent [19]

Chu et al.

[11] Patent Number: 6,106,377

[45] Date of Patent: Aug. 22, 2000

[54] STRUCTURE OF A SAND BLAST GUN

[76] Inventors: I-Tien Chu; I-Lung Chen, both of P.O. Box 82-144, Taipei, Taiwan

[21] Appl. No.: 09/139,574

[22] Filed: Aug. 25, 1998

[51] Int. Cl.[7] ..... B24C 3/00

[52] U.S. Cl. ..... 451/102; 451/90

[58] Field of Search ..... 451/90, 102

[56] References Cited

U.S. PATENT DOCUMENTS

| | | | |
|---|---|---|---|
| 2,107,084 | 2/1938 | Pletcher | 451/102 |
| 4,941,298 | 7/1990 | Fernwood et al. | 451/102 X |
| 5,605,496 | 2/1997 | Pickard | 451/90 |

*Primary Examiner*—Timothy V. Eley
*Assistant Examiner*—Anthony Ojini
*Attorney, Agent, or Firm*—A & J

[57] ABSTRACT

An improved structure of a sand blast gun includes a body, a guide tube accommodated in the body in a longitudinal direction, and a stop valve disposed in a radial direction. The stop valve has two guide posts. A shaft having a sleeve fitted on the outside straddles over upper portions of the guide posts. The guide posts are respectively fitted with pressure springs and inserted into holes of the body. An urging top end is firstly fixed on a center of a securing plate that is screwably mounted at the bottom side of the guide posts such that the urging top end extends into a radial round hole of the body to urge against a catgut tube to close the passage. When a trigger of the sand blast gun is pulled, it pushes the shaft and the guide posts to cause the pressure spring to retract to thereby cause the securing plate on the bottom of the guide posts and the urging top end to displace outwardly. The urging top end then disengages from the catgut tube to open the sand blast passage to achieve control of operation of sand blasting.

1 Claim, 6 Drawing Sheets

STRUCTURE OF A SAND BLAST GUN

BACKGROUND OF THE INVENTION (a) Field of the Invention

The present invention relates to a sand blast gun, and more particularly to a sand blast gun that is simple in construction and easy to operate and that can be held in one hand to control opening or closure of a stop valve.

(b) Description of the Prior Art

FIG. 1 shows a conventional sand blast control valve. In use, a user has to hold the control valve body 11 in one hand and pull the trigger 12 with the other hand so as to control the flow of sand blast. As operation of such control valve requires use of both hands, it is inconvenient.

SUMMARY OF THE INVENTION

Therefore, a primary object of the present invention is to provide an improved structure of a sand blast gun. According to the present invention, the gun body has a guide tube disposed internally and a stop valve disposed radially. The stop valve has two guide posts, and a shaft straddling over upper portions of the guide posts. The guide posts are respectively fitted with pressure springs and inserted into holes of the body. An urging top end is firstly fixed on a center of a securing plate that is screwably mounted at the bottom side of the guide posts such that the urging top end extends into a radial round hole of the body to urge against a catgut tube to close the passage. When a trigger of the sand blast gun is pulled, it pushes the shaft and the guide posts to cause the pressure spring to retract to thereby cause the securing plate on the bottom of the guide posts and the urging top end to displace outwardly. The urging top end then disengages from the catgut tube to open the sand blast passage.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
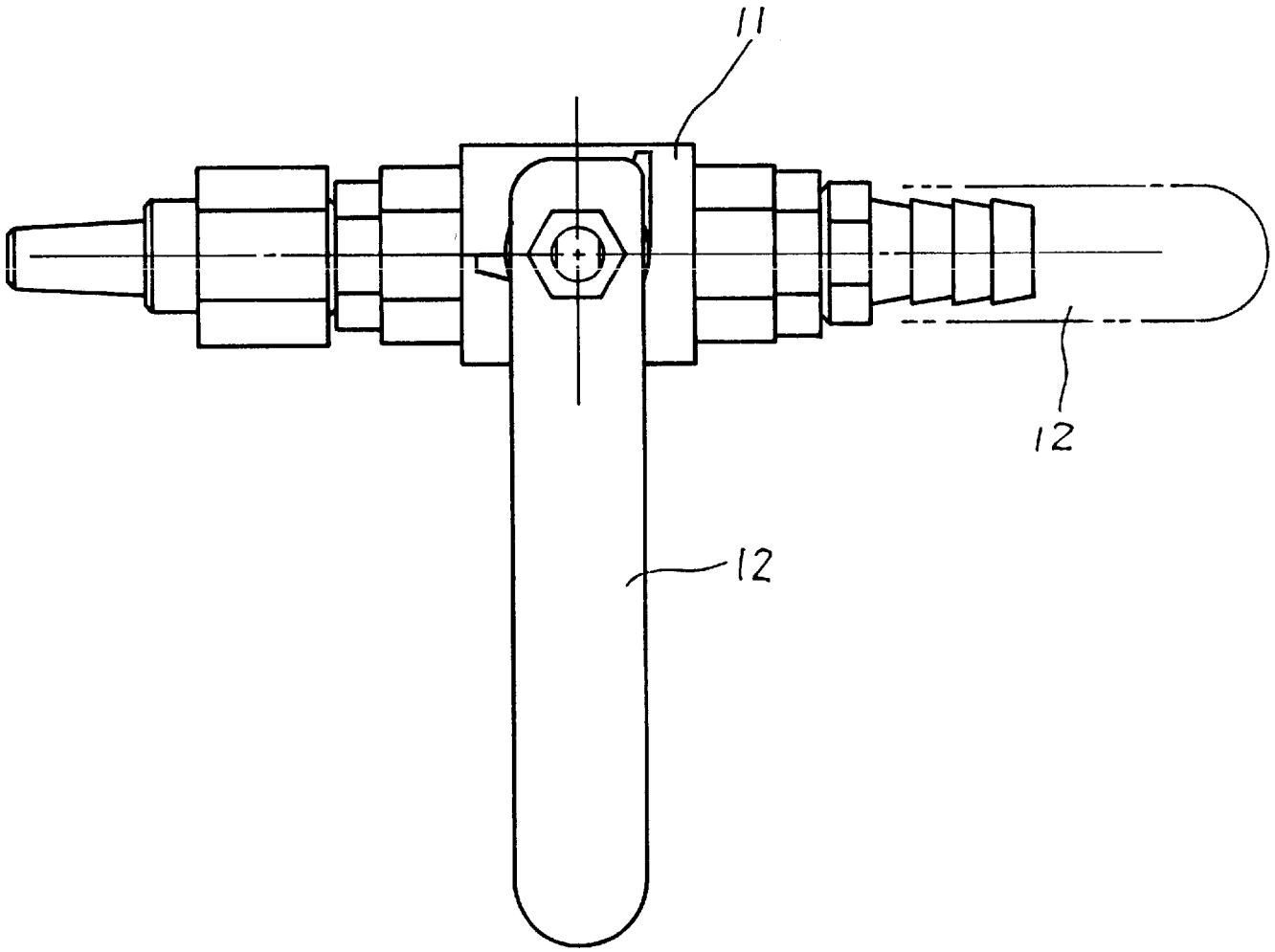
FIG. 1 is an assembled plan view of the prior art.
Figure 2:
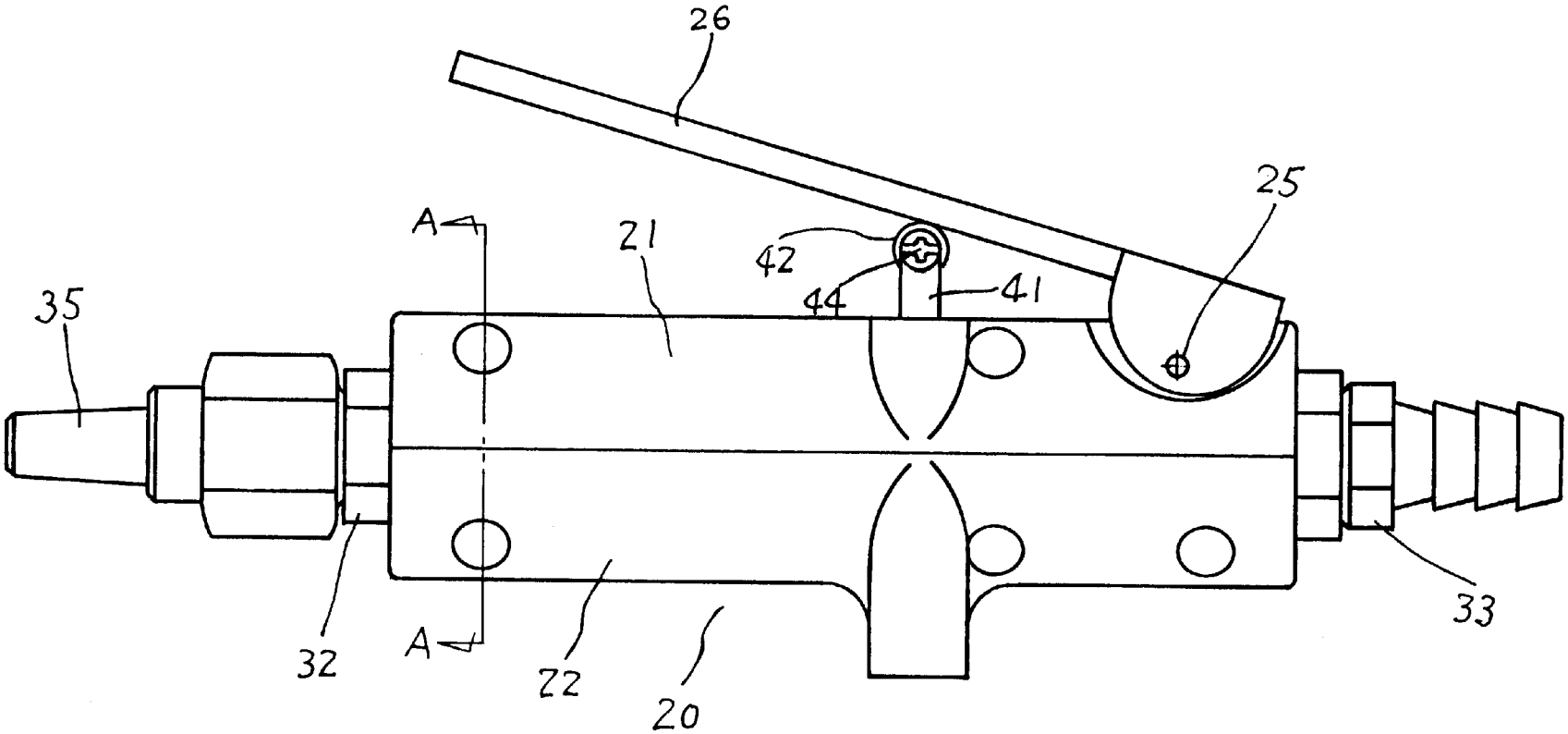
FIG. 2 is an assembled front view of the present invention.
Figure 3:
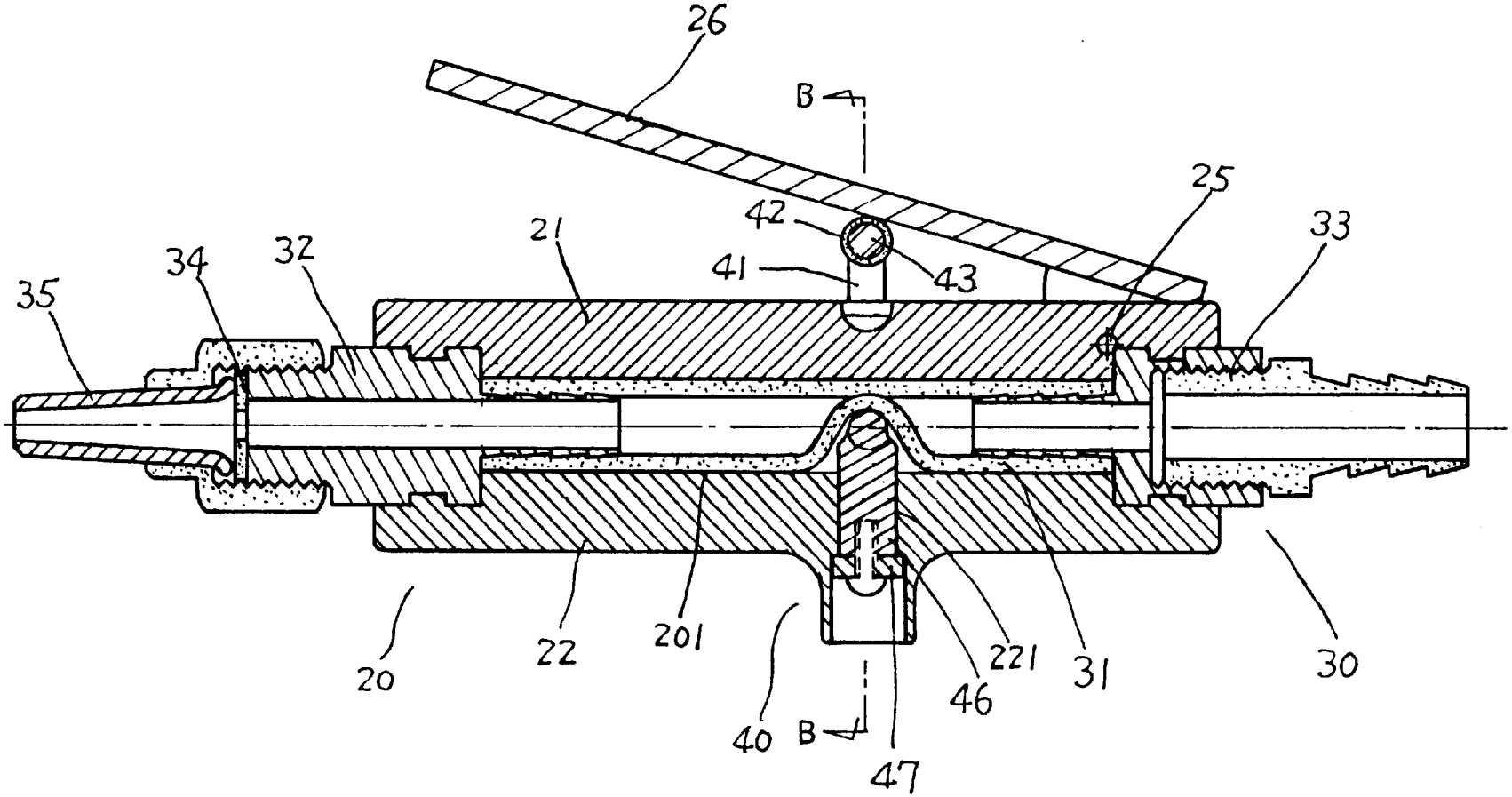
FIG. 3 is an assembled sectional view of the present invention.
Figure 5:
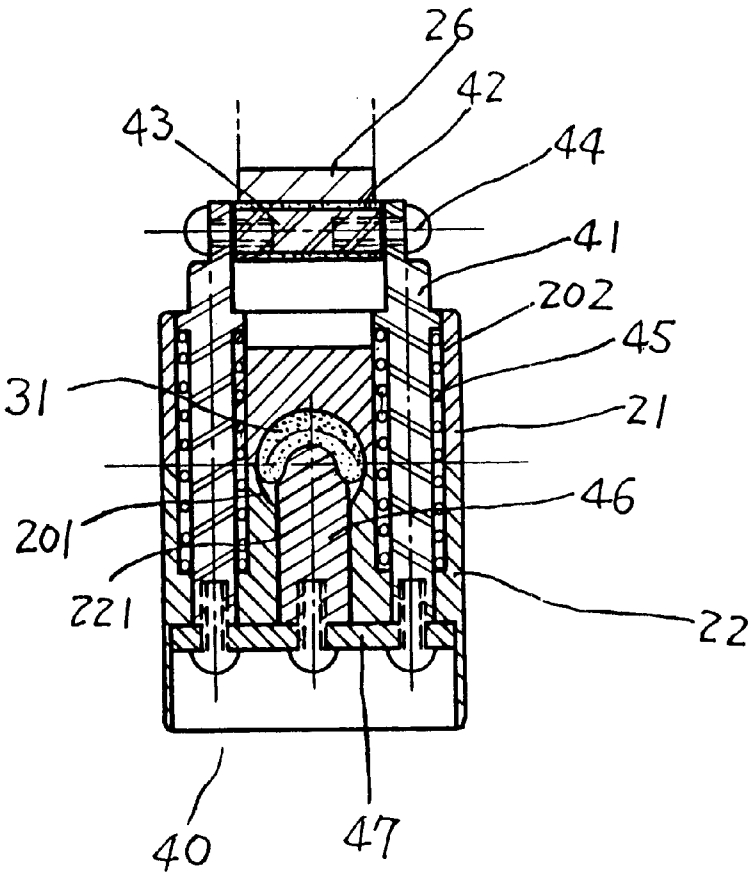
FIG. 5 is a sectional view of the present invention taken along line B—B of FIG. 3.
Figure 4:
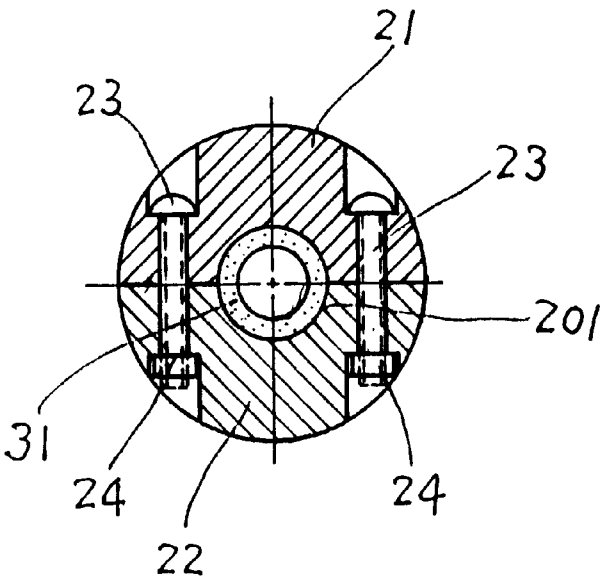
FIG. 4 is a sectional view of the present invention taken along line A—A of FIG. 2.

With reference to FIGS. 2–5, the improved structure of a sand blast gun according to the present invention is shown to comprise a body 20 that can be held by a user, a guide tube 30 disposed inside the body 20 along a longitudinal axis thereof, and a stop valve 40 disposed near the central portion of the body 20 along a radial direction. The stop valve 40 has an urging top end 46 for controlling adjustment and closure of a flexible catgut tube 31 of the guide tube 30.

The body 20 includes an upper shell 21 and a lower shell 22 connected by screws 23 and nuts 24 to form a cylindrical structure defining a through hole 201 therein. The lower shell 22 is radially provided with a round hole 221 near its central portion. The round hole 221 communicates with the through hole 201. Two sides of the round holes 221 are provided with holes 202 that pass through the upper and lower shells 21, 22. One side of the upper shell 21 is pivotally connected to a trigger 26 by means of a pin 25.

The guide tube 30 is located in the through hole 201 of the body 20. The flexible catgut tube 31 therein are insertably connected to couplings 32, 33 at front and rear ends thereof. The front coupling 32 is fitted with a packing ring 34 for screwable connection with a nozzle 35. The rear coupling 33 is adapted for receiving a hose unit to be connected to a sand blast machine. As these are well known in the art, they are not discussed in detail herein.

The stop valve 40 has two guide posts 41. A shaft 43 fitted with a sleeve 42 on the outside is straddled over upper portions of the guide posts 41 and locked in position by screws 44. Pressure springs 45 are respectively assembled to the two guide posts 41, which are inserted into the holes 202 of the body 20. The urging top end 46 is initially screwably fixed to the center of a securing plate 47, which is then screwably installed at the bottom of the guide posts 41 such that the urging top end 46 extends into the round hole 221 of the body 20 to urge against the catgut tube 31 so as to close the passage.

Figure 6:
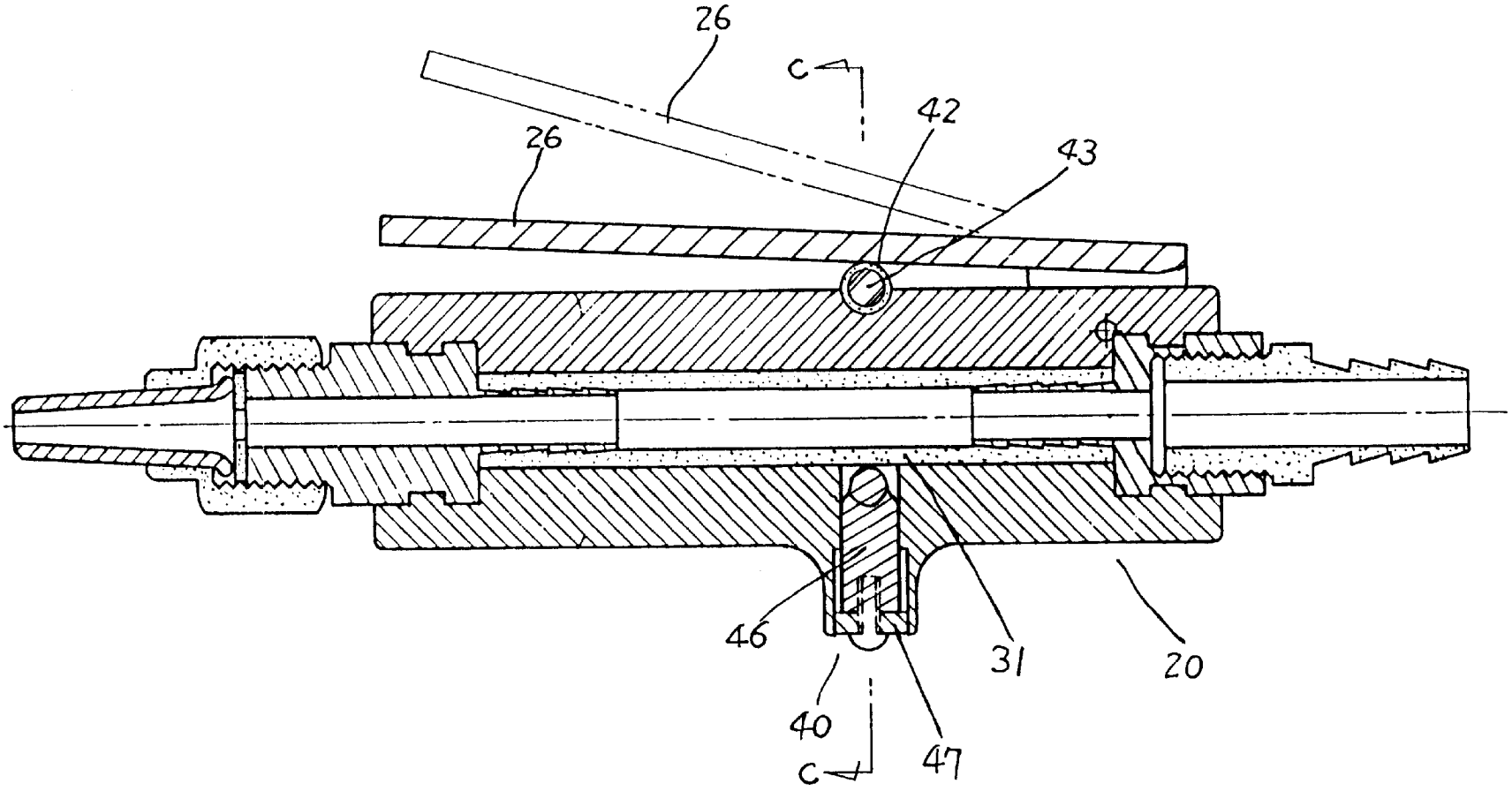
FIG. 6 is a schematic view illustrating use of the present invention.
Figure 7:
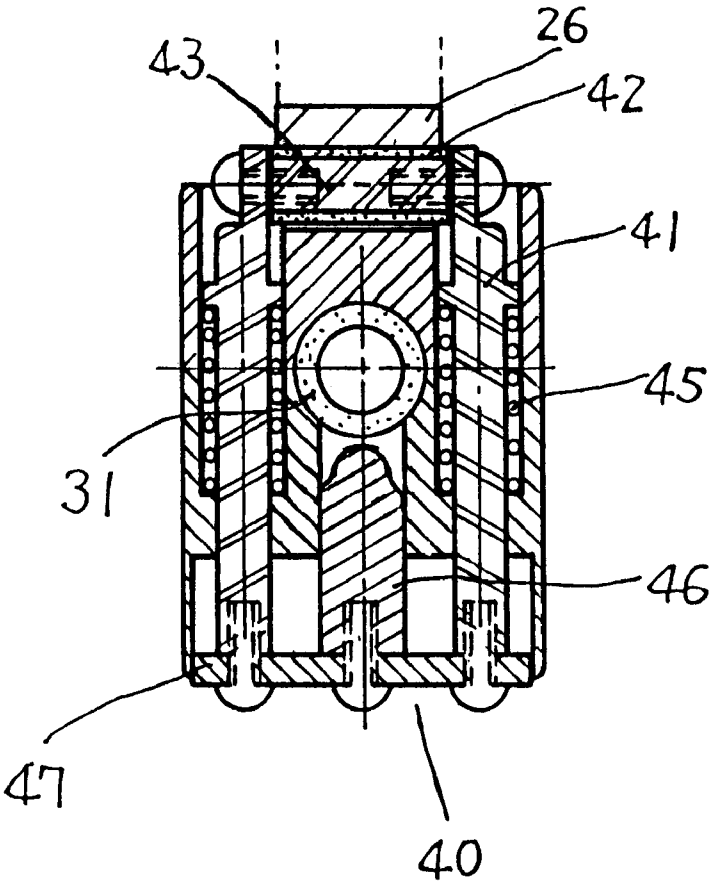
FIG. 7 is a sectional view taken along line C—C of FIG. 6.

Operation of the present invention is described hereinafter with reference to the drawings:

Referring to FIGS. 6 and 7, the user may hold the body 20 with one hand and pull the trigger 26, which presses against the shaft 43 in the sleeve 42 and the two guide posts 41 in sequence to cause the pressure spring 45 to retract. The securing plate 47 and the urging top end 46 at the bottom of the guide posts 41 then follow them to displace outwardly. At this point, the urging top end 46 disengages from the catgut tube 31 to adjust the passage of the sand blast. If the trigger 26 is released, the pushing force of the pressure spring 45 will cause the urging top end 46 of the stop valve 40 to reset and press against the catgut tube 31 to thereby close the passage of the sand blast. The present invention, as described, is simple in construction, and operation thereof is convenient. Besides, the problem of using both hands to control opening or closure of the valve is eliminated.

Although the present invention has been illustrated and described with reference to the preferred embodiment thereof, it should be understood that it is in no way limited to the details of such embodiment but is capable of numerous modifications within the scope of the appended claims.

We claim:

1. An improved structure of a sand blast machine, comprising a body that can be held in one hand, a guide tube disposed inside said body in a longitudinal direction, and a stop valve disposed near a central portion of said body in a radial direction, said stop valve having an urging top end that controls adjustment and closure of the passage of a catgut tube of said guide tube; wherein said body is comprised of upper and lower shells locked together to form a cylindrical body defining a through hole internally, said lower shell being provided with a round hole near a central portion thereof in a radial direction, said round hole communicating with said through hole and being provided with respective holes on two sides thereof that pass through said upper and lower shells, a trigger being pivotally connected to one side of said lower shell by a pin;

said guide tube is located in said through hole of said body, said catgut tube being disposed in a central portion of said guide tube and insertably connected to couplings on front and rear ends thereof, said front coupling being fitted with a packing ring that is adapted for screwable connection with a nozzle, said rear coupling being adapted to receive a hose for connection onto a sand blast machine; and said two guide posts of said stop valve have a shaft fitted with a sleeve straddling over upper portions thereof, said guide posts being respectively fitted with pressure springs and placed inside said holes on the two sides of said round hole of said body, said urging top end being firstly screwably fixed to a center of a securing plate that is screwably mounted at the bottom of said guide posts such that said urging top end extends into said round hole of said body to press against said catgut tube to close the passage, whereby said trigger is pulled in use to urge against said shaft in said sleeve and said guide posts in sequence, so that said pressure spring retracts to cause said securing plate on the bottom of said guide posts and said urging top end to displace outwardly therewith, further causing said urging top end to disengage from said catgut tube to adjust the sand blast passage, and whereby when said trigger is released, said pressure spring will cause said urging top end of said stop valve to reset and urge against said catgut tube to close the sand blast passage.

* * * * *